United States Patent [19]

Cook et al.

[11] Patent Number: 4,767,053

[45] Date of Patent: Aug. 30, 1988

[54] MULTIFUNCTION TOY STUNT SET

[75] Inventors: John Cook, Gardenia; George Soulakis, Hermosa Beach; Keith Hippely, Manhattan Beach, all of Calif.

[73] Assignee: Mattel, Inc., Hawthorne, Calif.

[21] Appl. No.: 94,470

[22] Filed: Sep. 4, 1987

[51] Int. Cl.[4] ..... A63H 18/02

[52] U.S. Cl. ..... 238/10 R; 238/10 F; 446/168; 446/444

[58] Field of Search ..... 238/10 R, 1, 10 A, 10 E, 238/10 F; 104/53, 54, 56; 446/168, 171, 173, 174, 444, 487; 273/86 C; 272/56.5 R

[56] References Cited

U.S. PATENT DOCUMENTS

| | | | |
|---|---|---|---|
| 1,599,699 | 9/1926 | Zabel . | |
| 1,599,982 | 9/1926 | Bauer . | |
| 1,695,310 | 12/1928 | Wüstendörfer . | |
| 2,767,986 | 10/1956 | Newberry . | |
| 3,604,148 | 9/1971 | Neuhierl | 238/10 R X |
| 3,621,602 | 11/1971 | Barcus et al. . | |
| 3,696,555 | 10/1972 | Bales et al. . | |
| 3,726,476 | 4/1973 | Porter et al. . | |
| 3,735,923 | 5/1973 | Brigham et al. . | |
| 3,814,021 | 6/1974 | McHenry . | |
| 4,185,409 | 1/1980 | Cheng . | |
| 4,221,076 | 9/1980 | Ozawa . | |
| 4,534,745 | 8/1985 | Jones et al. . | |
| 4,541,813 | 9/1985 | Ikeda . | |

*Primary Examiner*—Henry A. Bennet

*Attorney, Agent, or Firm*—Ronald M. Goldman; Melvin A. Klein; Daniel F. Sullivan

[57] ABSTRACT

A toy stunt set which can be used to form a loop and ramps for use during play with toy vehicles. Two tower members with engaging grooves are mounted on top of a base. A frame with flexible sheet pieces is positioned between the tower members. A rod at the end of a flexible member can be inserted into the grooves in order to form a loop and ramps. Toy vehicles may be rolled onto the loop and ramps and through the frame and flexible pieces. The flexible member can be used by itself to form individual ramps. A tumble member may be connected near the end of the flexible member so that the toy vehicles will flip after rolling onto the loop or ramps.

7 Claims, 4 Drawing Sheets

10
12
14
16
17
18
19
20
21
22
23
24
25
26
27
28
29
32
34
36
37
38
39
40
42

MULTIFUNCTION TOY STUNT SET

BACKGROUND OF THE INVENTION

The present invention relates generally to toy stunt sets and, more particularly, to a compact multifunction toy stunt set having parts which can be coupled together to form a loop and ramps for use during play with toy vehicles.

Toy stunt sets and apparatus which can be used to form loops, ramps, or hoops for use with toy vehicles are described in U.S. Pat. Nos. 4,541,813; 4,534,745; 4,221,076; 4,185,409; 3,814,021; 3,735,923; 3,726,476; 3,696,555; 3,621,602; 2,767,986; 1,695,310; 1,599,982; and 1,599,699. However, none of the above patents discloses a simple, inexpensive, compact multifunction toy stunt set having parts that can be coupled together to form a loop and ramps which a child may use with toy vehicles. Accordingly, there is a need in the toy manufacturing arts for such a multifunction toy stunt set.

SUMMARY OF THE INVENTION

It is an object of this invention to provide a multifunction toy stunt set which can be used to form a loop and ramps for use with toy vehicles.

It is another object of this invention to provide a multifunction toy stunt set having a flexible member which can be used to form a loop and ramps.

It is still another object of this invention to provide a multifunction toy stunt set having a frame with flexible sheet pieces which can be used in conjunction with the flexible member.

It is still another object of this invention to provide a multifunction toy stunt set having a tumble member which can be used in conjunction with the flexible member.

These and other objects and advantages are attained by a multifunction toy stunt set which can be used to form a loop and ramps for use during play with toy vehicles. Two tower members with engaging grooves are mounted on top of a base. A frame with flexible sheet pieces is positioned between the tower members. A rod at the end of a flexible member can be inserted into the grooves in order to form a loop and ramps. Toy vehicles may be rolled onto the loop and ramps and through the frame and flexible pieces. The flexible member can be used by itself to form individual ramps. A tumble member may be connected near the end of the flexible member so that the toy vehicles will flip after rolling onto the loop or ramps.

The various features of the present invention will be best understood together with further objects and advantages by reference to the following description of the preferred embodiment taken in connection with the accompanying drawings.

DESCRIPTION OF THE PREFERRED EMBODIMENT

The following specification taken in conjunction with the drawings sets forth the preferred embodiment of the present invention in such a manner that any person skilled in the toy manufacturing arts can use the invention. The embodiment of the invention disclosed herein is the best mode contemplated by the inventors for carrying out their invention in a commercial environment although it should be understood that various modifications can be accomplished within the parameters of the present invention.

Figure 1:
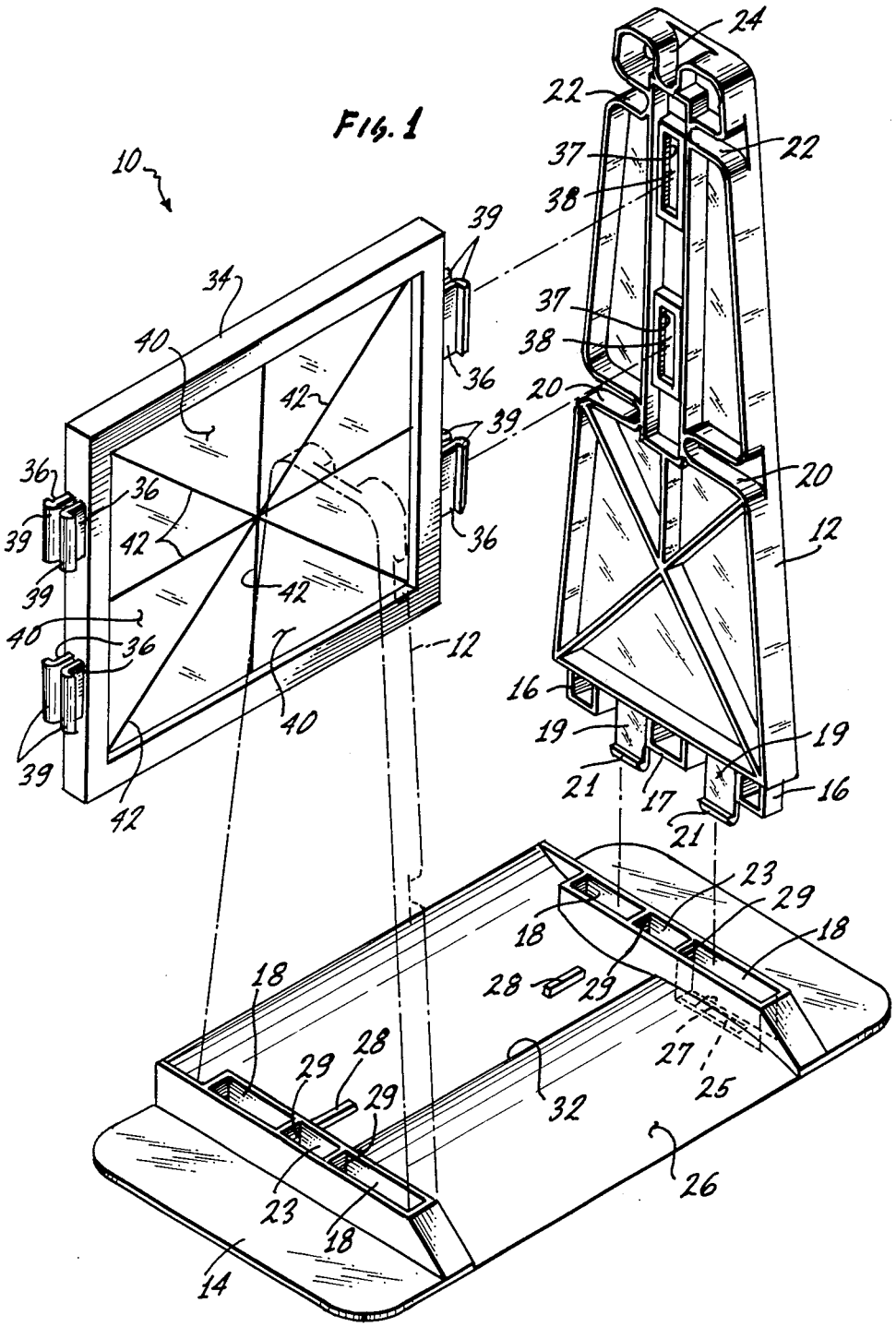
FIG. 1 is a perspective view showing a base, frame and one vertical tower member used for the toy stunt set of the present invention.
Figure 2:
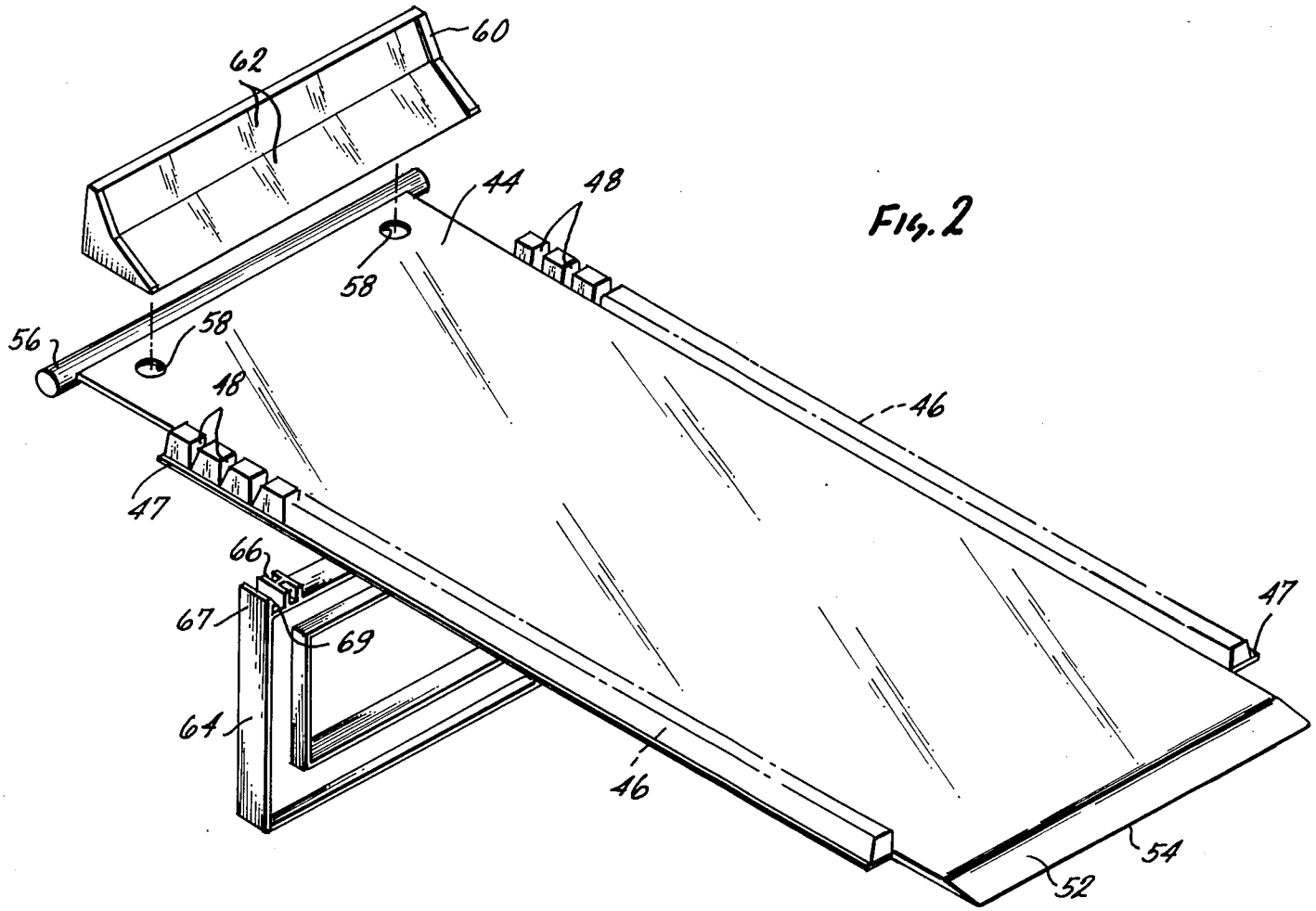
FIG. 2 is a perspective view showing how a flexible member can be used with tumble and support members to form a ramp.
Figure 3:
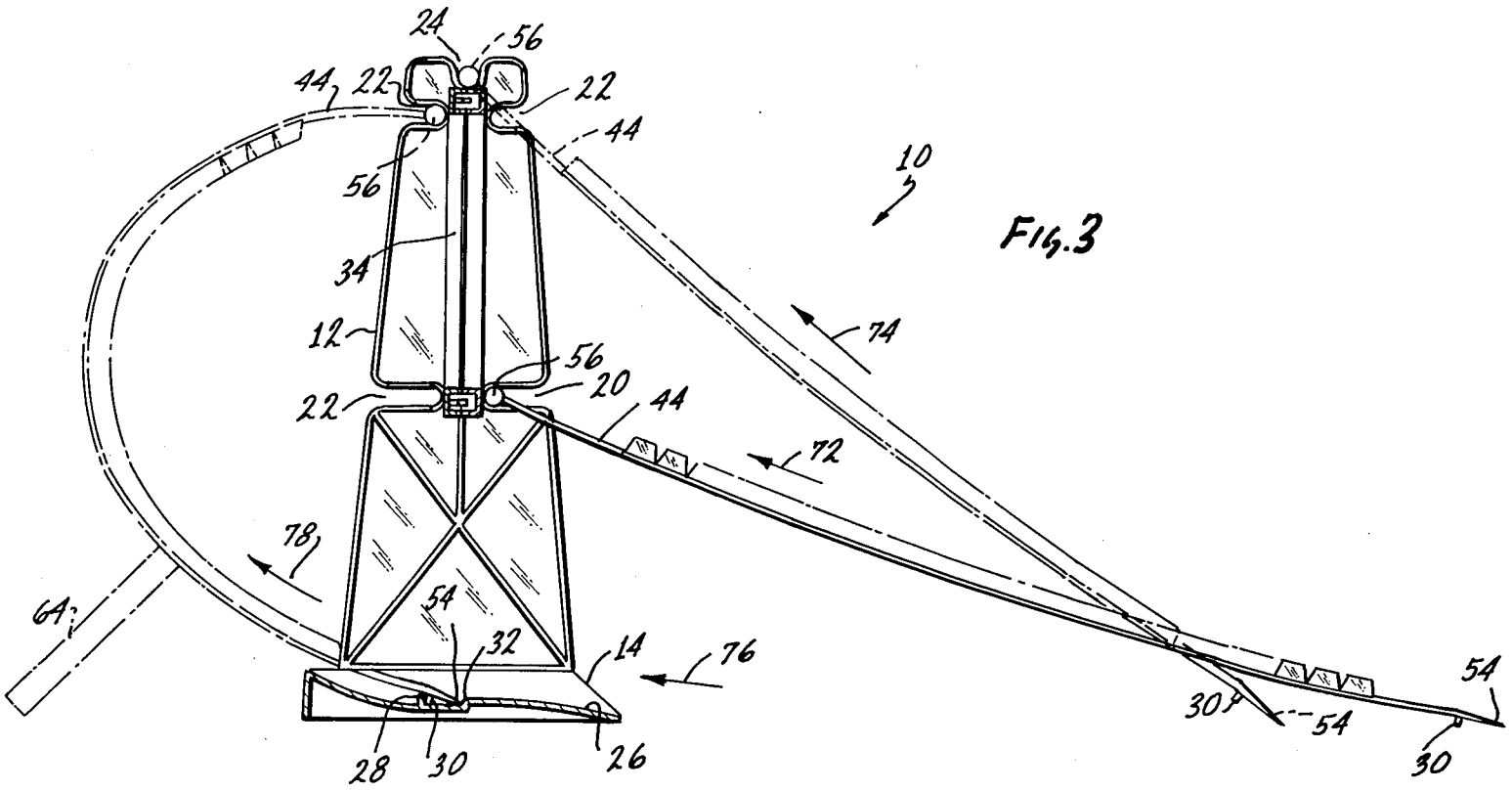
FIG. 3 is a side elevational view in partial cross-section showing how the flexible member and support member can be used in conjunction with the base and vertical tower members to form a loop and ramps.

Referring now to the drawings and particularly to FIGS. 1 through 3, a preferred embodiment of the toy stunt set 10 of the present invention is disclosed. Two vertical tower members 12 are supported by a base 14. (Note that one of the lower members 12 is represented by broken lines in FIG. 1). The tower members 12 have integral downward extensions 16, 17 and 19 at the lower ends thereof which engage elongated slots 18 and 23 formed by webs 29 at the top of base 14. Each tower member 12 has engaging grooves 20 about half way up the height thereof, engaging grooves 22 near the top thereof and engaging groove 24 at the top thereof, all as shown in FIG. 1. The base 14 has surface 26, upward protuberances 28 and edge 32 as shown in FIGS. 1 and 3.

A frame 34 is positional between the two tower members 12 and connected to the tower members by integral side extensions 36 which engage slots 38 passing through the tower members. Attached to the frame are a plurality of separate flexible sheet pieces 40 separated at lines 42 so that each piece 40 is free to move, flex or bend by itself independent of the other pieces 40. The pieces 40 may be made out of any flexible sheet material such as paper, plastic, or the like. As such, a toy vehicle (not shown) may pass through frame 34 and through pieces 40 by pushing or forcing the pieces 40 apart, each piece 40 bending or flexing as the vehicle passes through frame 34.

Referring again to FIG. 1, extensions 17 of the tower members 12 engage slots 23 and extensions 16 and 19 engage slots 18. Each of slots 18 has an aperture 25 at the bottom thereof which passes through the base 14. The towers 12 are mounted on the base 14 by pushing extensions 19 into apertures 25 which causes lips 21 at the ends of extensions 19 to engage edges 27 of the apertures 25. Likewise, extensions 36 of the frame 34 are pushed into slots 38 until lips 39 at the ends of the extensions 36 engage edges 37 at both sides of slots 38.

Figure 4:
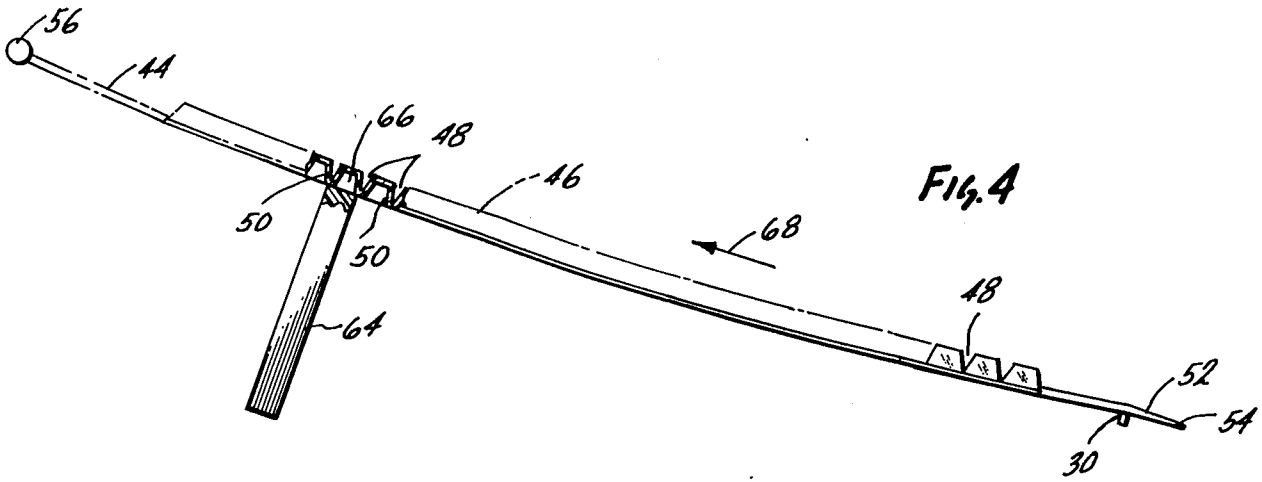
FIG. 4 is a side elevational view in partial cross-section of the flexible and support member connected together to form a ramp.
Figure 5:
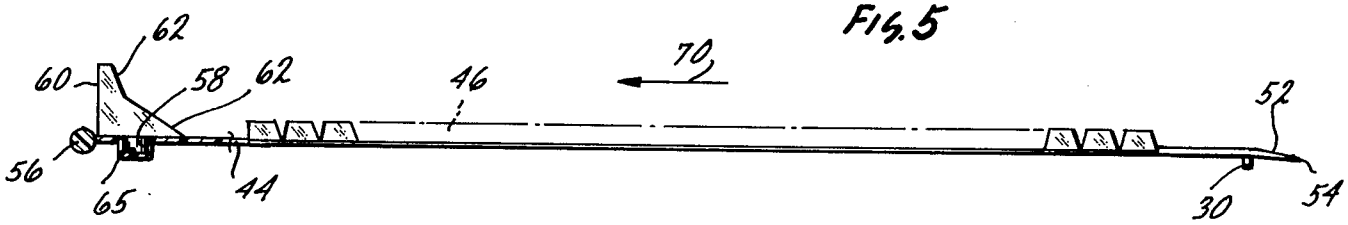
FIG. 5 is a side elevational view in partial cross-section showing the tumble and flexible members connected together with the flexible member orientated in a horizontal position.

Referring now to FIGS. 2, 4 and 5, a flexible member 44 is shown which is capable of being bent to form different loops or ramps. The flexible member 44 is flat, sheet-like and relatively thin and may be made out of any desirable flexible material such as plastic, or the like. Member 44 has integral side members 46 at both sides thereof. Each of the side members 46 has a plurality of notches or openings 48 in the top thereof to provide flexibility and a plurality of apertures 50 in the bottom thereof (see FIG. 4). Member 44 has an inclined surface 52 and downward protuberances 30 at one end 54 and an integral engaging bar 56 and apertures 58 at the other end. Side members 46 may extend all the way to the engaging bar 56 if desired.

A tumble member 60 with inclined surfaces 62 as shown in FIG. 2 may be releasably connected to the top of flexible member 44 by pegs 65 which releasably engage apertures 58 of member 44 (see FIGS. 2 and 5). In addition, a support member 64 may be releasably connected to the bottom of flexible member 44 by integral upward extensions 66 and 67 which releasably engage any of apertures 50 of member 44 and elongated ridges 47 extending along the lengths of both side members 46 (see FIGS. 2 and 4). Note that extensions 66 and 67 exist at both sides of support member 64. Support member 64 is connected to member 44 by pushing extensions 66 into selected apertures 50 which causes lips 69 at the ends of extensions 67 to engage ridges 47.

The support member 64 may be used to elevate flexible member 44 over a supporting surface (not shown) so that it can be used as a ramp as shown in FIG. 4. In such a case, toy vehicles (not shown) enter member 44 from the supporting surface at end 54 over slanted surface 52 in the direction of arrow 68. Alternatively, member 44 may be placed in a generally horizontal position on top of the supporting surface as shown in FIG. 5. Toy vehicles would then enter member 44 over surface 52 in the direction of arrow 70. If tumble member 60 is connected to member 44 as shown in FIG. 5, then a toy vehicle will flip after it comes into contact with surfaces 62 of the tumble member 60. Note that tumble member 60 may also be used with member 44 when it is being used to form a ramp or loop.

Referring now to FIG. 3, the flexible member 44 can be used in conjunction with the vertical tower members 12 to form different ramps as shown. Note that the support member 64 is not needed to form the ramps, but may be used to help support the ramps if desired. When used this way, end 54 of the flexible member 44 is placed on top of a supporting surface (not shown) and engaging bar 56 is placed into any of engaging grooves 20, 22 and 24 to form any desired ramp. Toy vehicles (not shown) may roll on top of member 44 at end 54 and continue up the ramps in the directions of arrows 72 and 74. When rod 56 is placed into grooves 20, toy vehicles will pass through frame 34 and flexible sheet pieces 40 after they have rolled up the ramp.

A loop may be formed by using member 44 in conjunction with the tower members 12 and the supporting member 64 as shown in FIG. 3. In such a case, engaging rod 56 is inserted into groove 22 and end 54 is placed against edge 32 while the portion of member 44 near end 54 is supported by protuberances 28 of the base 14 and held in place by protuberances 30 which engage protuberances 28 as shown. Note that member 64 may be used to support the loop. When in this position, toy vehicles (not shown) may roll on top of surface 26 of the base 14 as indicated by arrow 76 and proceed up the loop as indicated by arrow 78. After reaching the top of the loop, the toy vehicles pass through frame 34 and pieces 40.

It is important to note that the location of the engaging grooves 20, 22 and 24 may be varied up and down the height of the tower members 12 in different embodiments of the toy stunt set. Also, the number of engaging grooves may be varied. As such, a variety of different loops and ramps may be provided.

The above description discloses the preferred embodiment of the present invention. However, persons of ordinary skill in the toy field are capable of numerous modifications once taught these principles. Accordingly, it will be understood by those skilled in the art that changes in form and details may be made to the above-described embodiment without departing from the spirit and scope of the invention.

We claim:

1. A multifunction toy stunt set for use with toy vehicles comprising:

a base;

two tower members mounted on said base, said tower members having a plurality of engaging grooves;

a frame having a plurality of flexible sheet pieces, said frame being mounted between said tower members; and a flexible member having an engaging rod at one end thereof, said engaging rod capable of releasably engaging any one of said engaging grooves in order to form a loop and different ramps, said flexible member having another end thereof capable of (a) releasably engaging said base in order to form said loop and (b) supporting said flexible member on a supporting surface in order to form said different ramps.

2. The multifunction toy set of claim 1 further comprising a supporting member capable of releasably engaging said flexible member in order to help support said flexible member on said supporting surface.

3. The multifunction toy set of claim 2 further comprising a tumble member capable of releasably engaging the top side of said flexible member in order to provide flipping of toy vehicles when said vehicles are rolling on top of said flexible member.

4. The multifunction toy stunt set of claim 3 wherein said flexible member has side members extending along both sides thereof with apertures therein and elongated ridges and said supporting member has extensions capable of releasably engaging said apertures and said ridges of said side members.

5. The multifunctional toy stunt set of claim 4 wherein said flexible member has apertures therein near said one end and said tumble member has pegs capable of releasably engaging said apertures near said one end of said flexible member.

6. The multifunction toy stunt set of claim 5 wherein said frame has side extensions with lips capable of operably engaging slots in said tower members and said tower members have downward extensions capable of engaging slots in said base, each of said tower members have downward extensions capable of engaging slots in said base, each of said tower members having two of said downward, extensions with lips capable of operably engaging apertures in two of said slots in said base.

7. A multifunction toy set for use with toy vehicles comprising:

a base having elongated slots therein and protuberances extending upward therefrom, two of said elongated slots having apertures therein;

two tower members mounted on said base, each of said tower members having slots therein, extensions at the bottom thereof, and engaging grooves (a) about half way up the height thereof, (b) near the top thereof and (c) at the top thereof, said extensions of said tower members capable of engaging said elongated slots of said base, each of said tower members having two of said extensions with lips capable of operably engaging said apertures in said elongated slots of said base;

a frame having extensions with lips and a plurality of flexible sheet pieces, said frame being mounted between said tower members, said extensions with lips of said frame capable of operably engaging said slots of said tower members;

a flexible member having an engaging rod at one end thereof, said engaging rod capable of releasably engaging any one of said engaging grooves in order to form a loop and ramps, said flexible member having another end thereof capable of (a) releasably engaging said base in order to form said loop and (b) supporting said flexible member on a supporting surface in order to form said different ramps, said flexible member having side members extending along both sides thereof with apertures in the bottom sides thereof and elongated ridges, said flexible member having apertures therein near said one end and downward protuberances near said another end, said downward protuberances capable of engaging said upward protuberances of said base;

a supporting member capable of releasably engaging said flexible member in order to help support said flexible member on said supporting surface, said supporting member having extensions capable of releasably engaging said apertures and said ridges of said side members, two of said extensions of said supporting member having lips capable of operably engaging said ridges; and a tumble member capable of releasably engaging the top side of said flexible member in order to provide flipping of toy vehicles when said vehicles are rolling on top of said flexible member, said tumble member having pegs capable of releasably engaging said apertures near said one end of said flexible member.

* * * * *